US005918932A

United States Patent [19]

Morrison et al.

[11] Patent Number: 5,918,932

[45] Date of Patent: Jul. 6, 1999

[54] ILLUMINATED FURNITURE

[76] Inventors: James Morrison, 653 Harless Pl., West Hempstead, N.Y. 11552; Robert Wisniewski, Jr., 177 Bedford Ave., Merrick, N.Y. 11566

[21] Appl. No.: 08/901,655

[22] Filed: Jul. 28, 1997

[51] Int. Cl.[6] ..... A47C 7/62

[52] U.S. Cl. ..... 297/217.6; 297/217.3; 108/23; 211/153

[58] Field of Search ..... 297/217.6, 217.3; 108/23; 211/134, 153

[56] References Cited

U.S. PATENT DOCUMENTS

| | | | |
|---|---|---|---|
| 2,090,248 | 8/1937 | Chakow | 108/23 |
| 2,593,886 | 4/1952 | Johnson | 108/23 X |
| 2,891,139 | 6/1959 | Wass et al. | 108/23 |
| 3,624,381 | 11/1971 | Pollack et al. | 108/23 |
| 5,171,060 | 12/1992 | Kaye | 297/217.6 X |
| 5,738,018 | 4/1998 | Burnett | 108/23 |

FOREIGN PATENT DOCUMENTS

| | | | |
|---|---|---|---|
| 8604493 | 8/1986 | WIPO | 108/23 |

*Primary Examiner*—Laurie K. Cranmer
*Attorney, Agent, or Firm*—Michael I. Kroll

[57] ABSTRACT

A piece of illuminated furniture (10) comprises a diffuser (12) built therein that spreads light evenly. A light source (14) is within the diffuser (12) to produce illumination therefrom.

8 Claims, 7 Drawing Sheets

ILLUMINATED FURNITURE

BACKGROUND OF THE INVENTION

1. Field of the Invention

The instant invention relates generally to movable equipment and more specifically it relates to illuminated furniture. The illuminated furniture incorporates light sources within diffuser to produce illumination, as well as to serve ordinary their ordinary function within a room.

2. Description of the Prior Art

Numerous movable equipment have been provided in prior art that are adapted to be necessary, useful and desirable articles for rooms, such as chairs, tables or beds, that are fit for use within the rooms. While these units may be suitable for the particular purpose to which they address, they would not be as suitable for the purposes of the present invention as heretofore described.

SUMMARY OF THE INVENTION

A primary object of the present invention is to provide illuminated furniture that will overcome the shortcomings of the prior art devices.

Another object is to provide illuminated furniture that will incorporate light sources, such as lamps, within diffusers being translucent material, so as to produce illumination, as well as to serve their ordinary function within a room of a building.

An additional object is to provide illuminated furniture that eliminates the need for light fixtures and lamps to light a room, since the light sources within the diffusers will produce all the illumination needed to light up the room.

A further object is to provide illuminated furniture that is simple and easy to use.

A still further object is to provide illuminated furniture that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
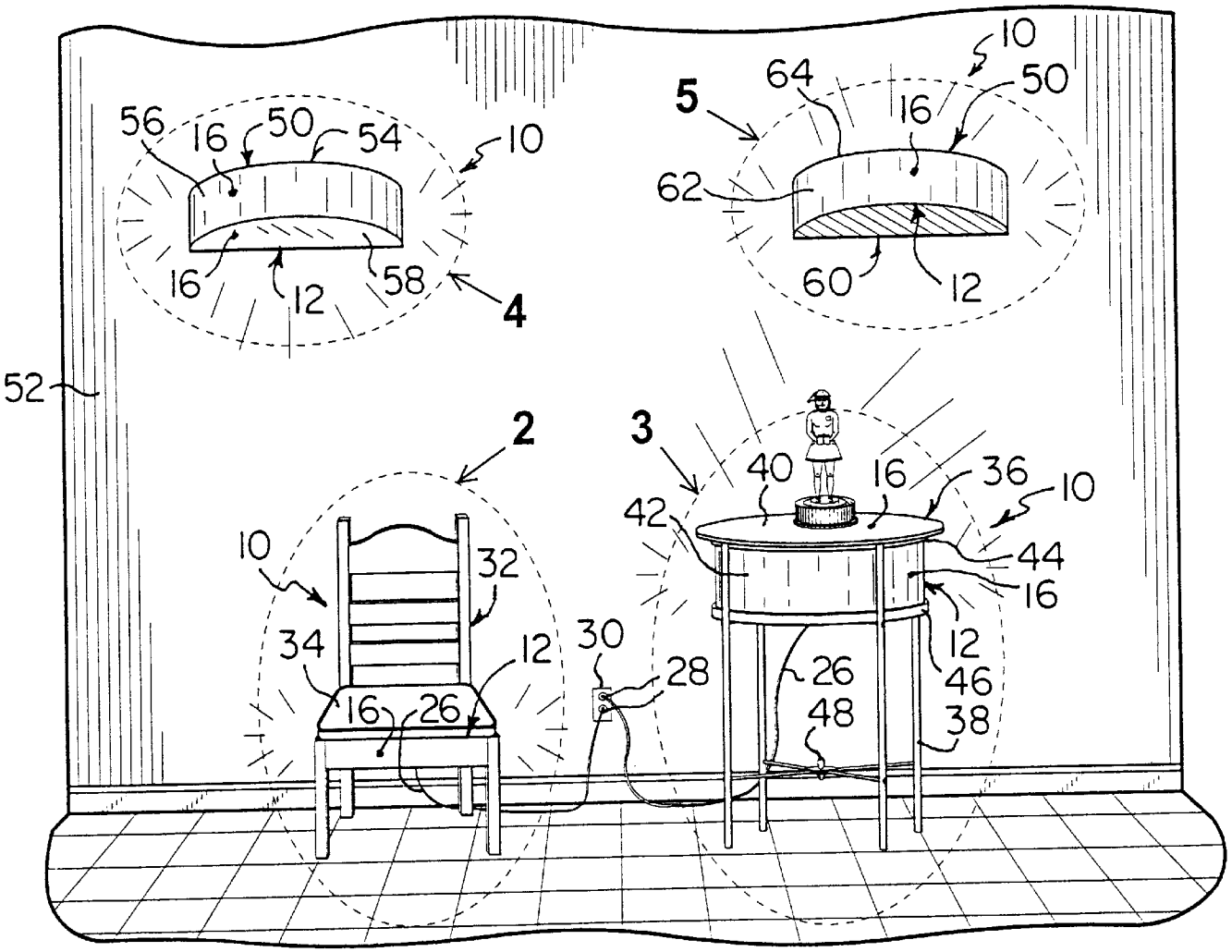
FIG. 1 is a perspective view of a portion of a room showing the instant invention therein, being different types of movable articles.
Figure 2:
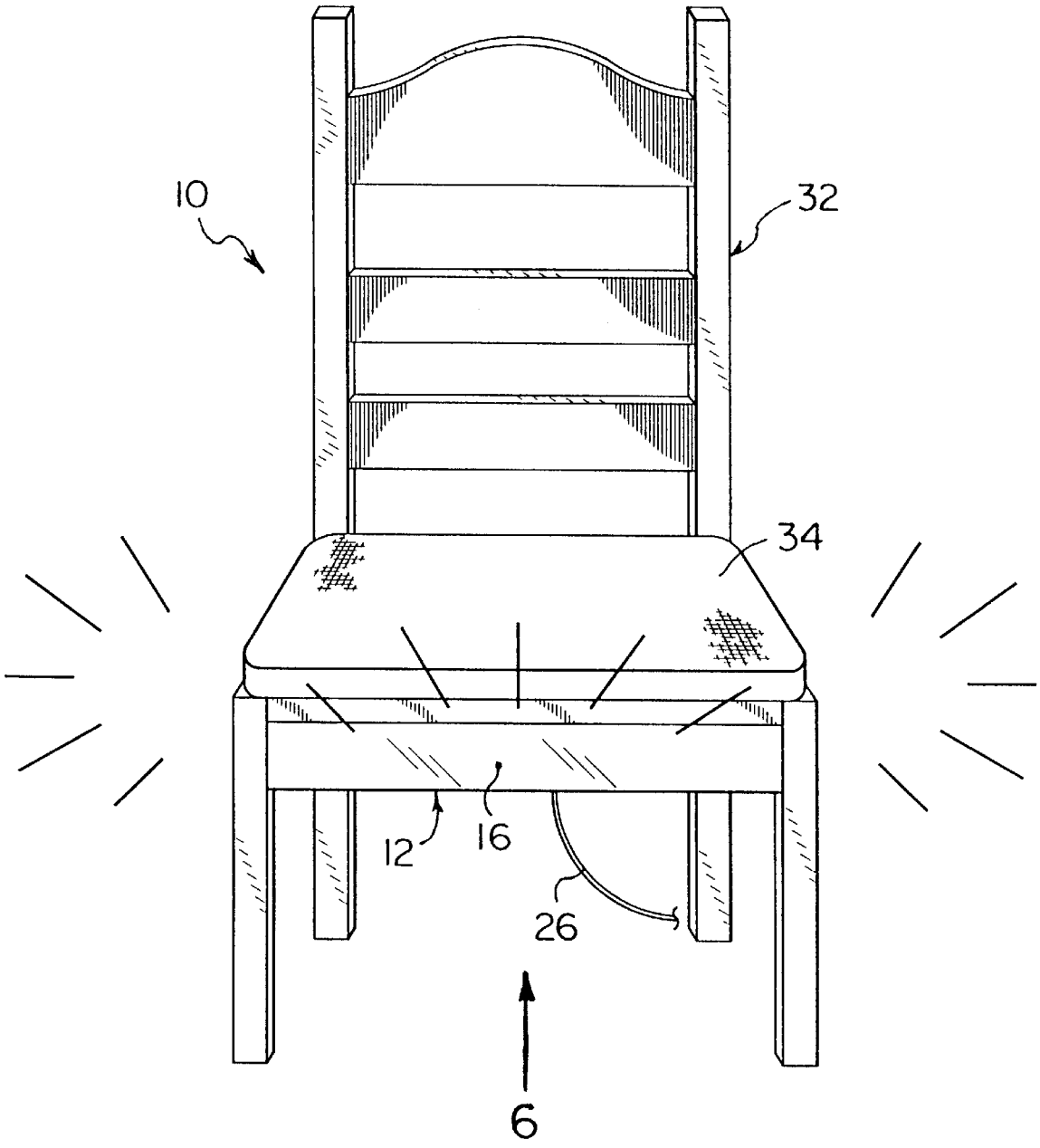
FIG. 2 is an enlarged perspective view as indicated by arrow 2 in FIG. 1, in which the instant invention is a chair.
Figure 3:
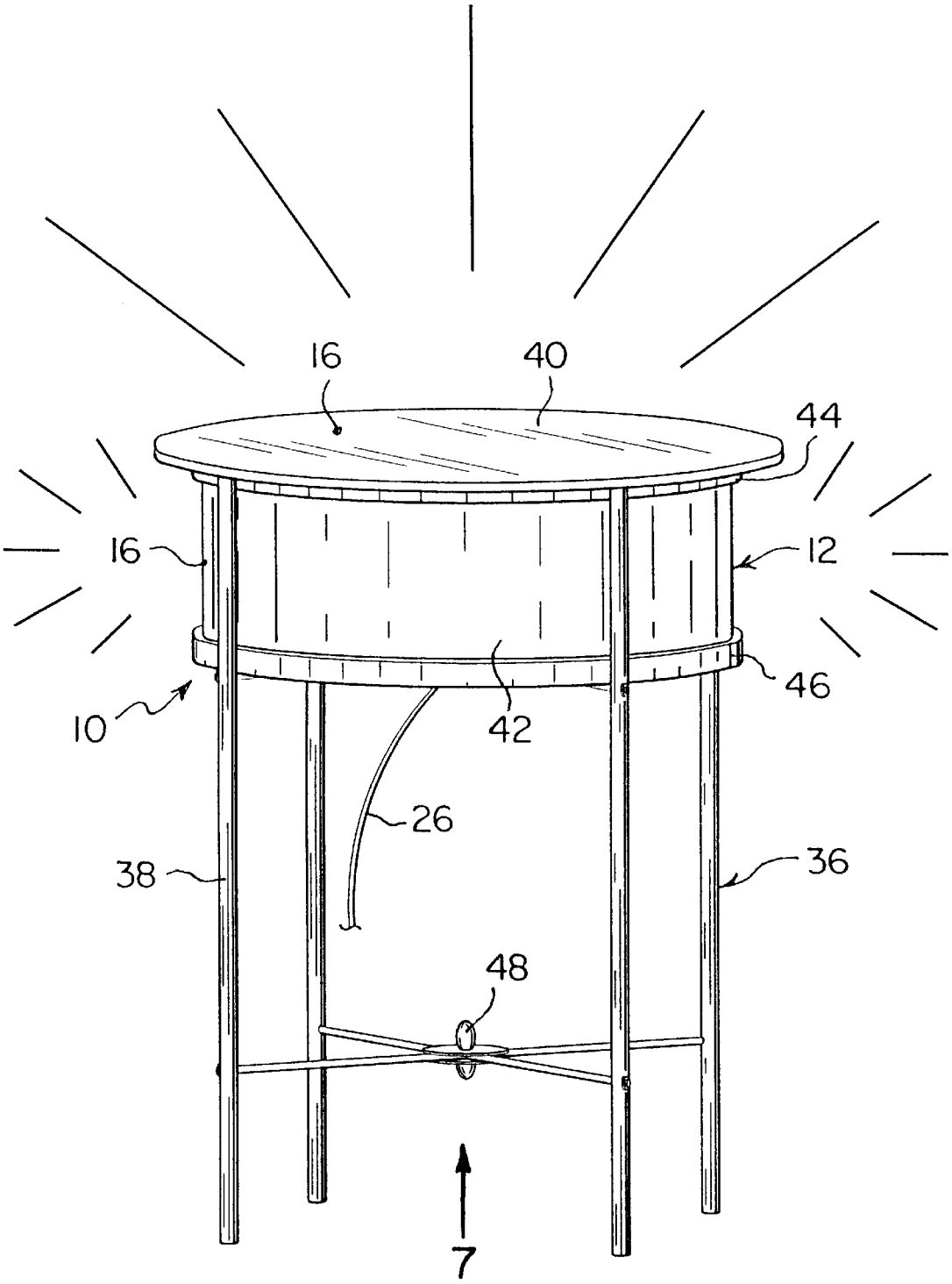
FIG. 3 is an enlarged perspective view as indicated by arrow 3 in FIG. 1, in which the instant invention is a table.
Figure 4:
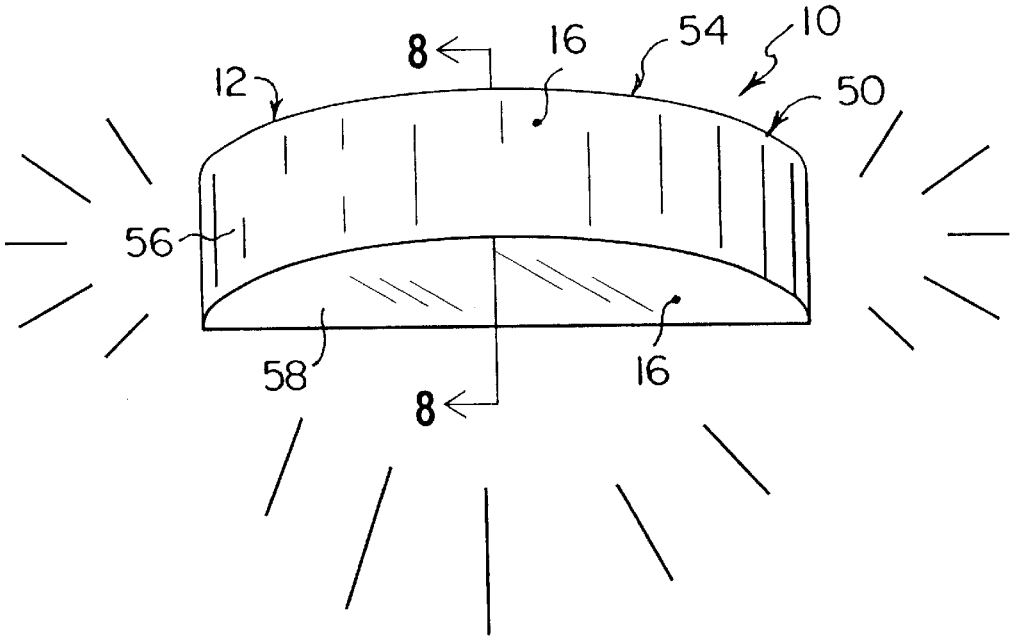
FIG. 4 is an enlarged perspective view as indicated by arrow 4 in FIG. 1, in which the instant invention is a first type of shelf.
Figure 5:
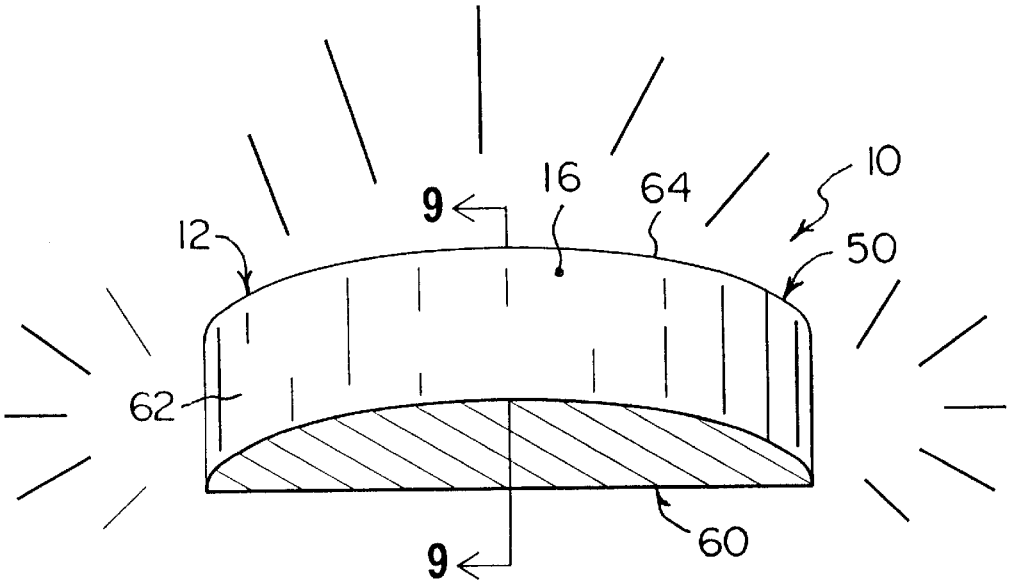
FIG. 5 is an enlarged perspective view as indicated by arrow 5 in FIG. 1, in which the instant invention is a second type of shelf.
Figure 6:
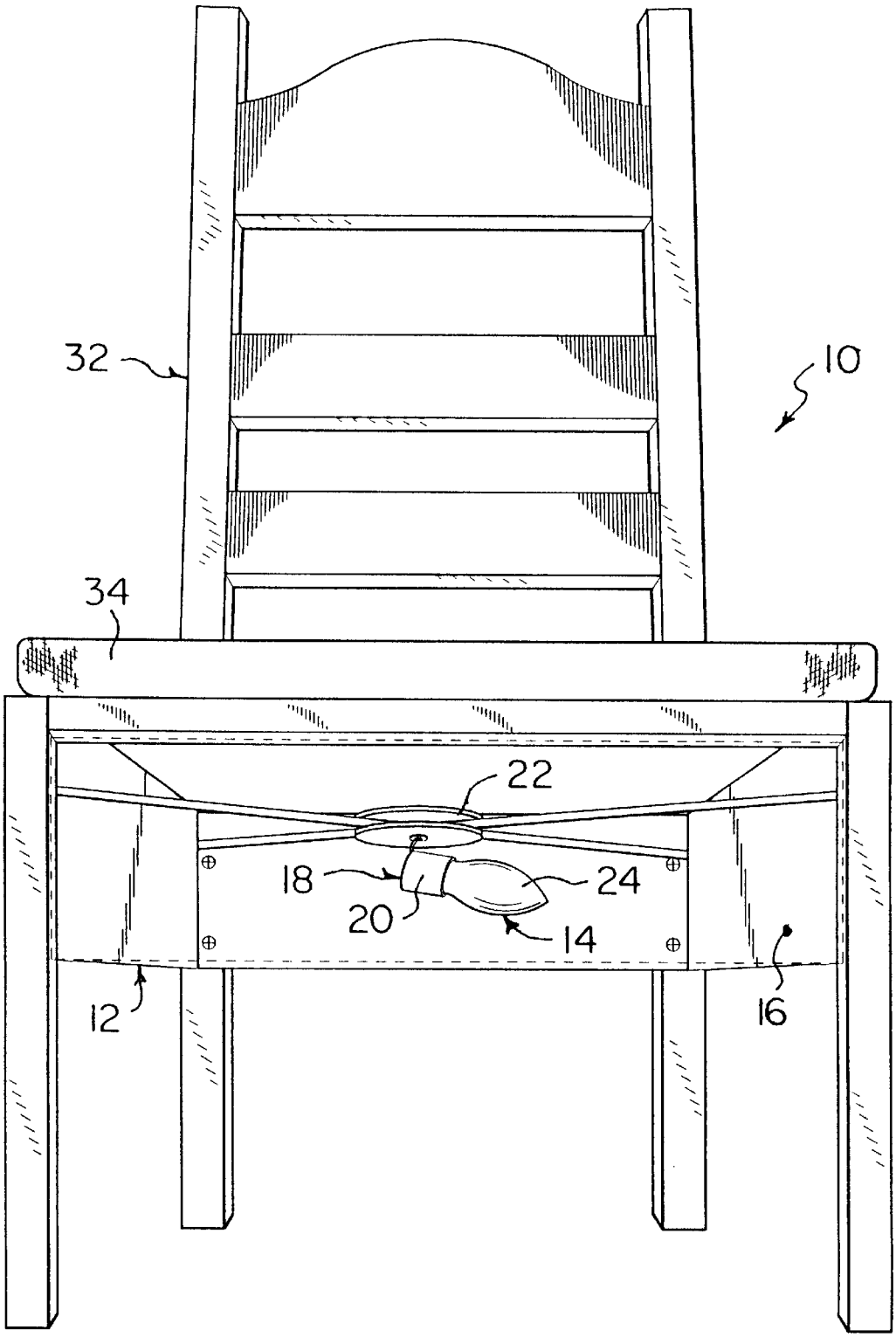
FIG. 6 is a perspective view taken in the direction of arrow 6 in FIG. 2, with the front portion of the diffuser shown in phantom.
Figure 7:
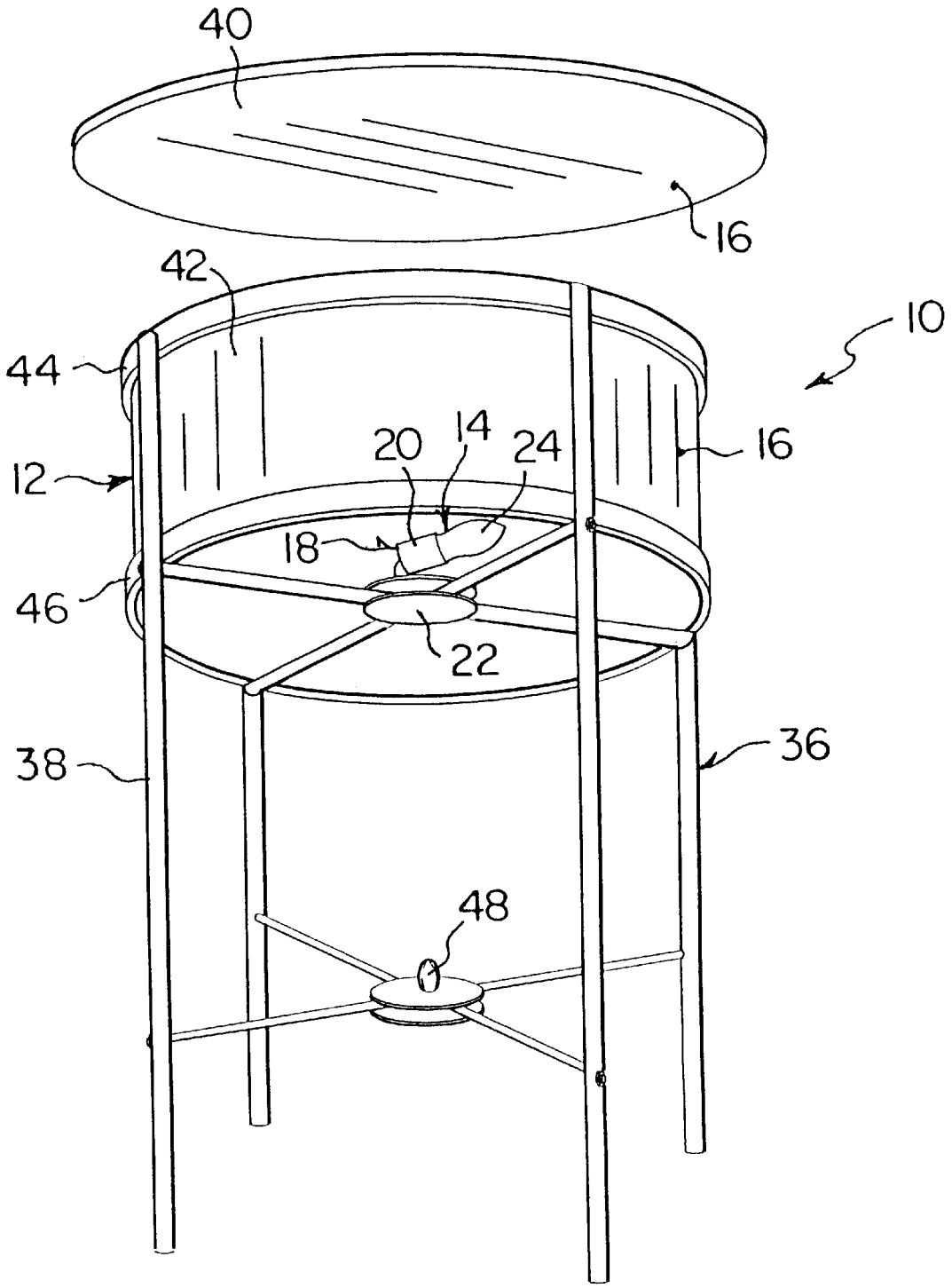
FIG. 7 is a perspective view taken in the direction of arrow 7 in FIG. 3, with the table top exploded therefrom.

Turning now descriptively to the drawings, in which similar reference characters denote similar elements throughout the several views, FIGS. 1 to 9 illustrate a piece of illuminated furniture 10 of the present invention. With regard to the reference numerals used, the following numbering is used throughout the various drawing figures.

10 a piece of illuminated furniture
12 diffuser of 10
14 light source of 10 in 12
16 transparent material for 12
18 lamp for 14
20 socket shell of 18
22 bracket of 18
24 light bulb of 18
26 power cord of 18
28 electric plug of 18 on 26
30 wall socket
32 chair for 10
34 seat of 32
36 table for 10
38 leg of 36
40 top of 36
42 cylindrical band of 12 in 36
44 first ring of 12 in 36
46 second ring of 12 in 36
48 adjustable support assembly in 36
50 shelf for 10
52 wall
54 semicircular housing for 50
56 front partition of 54 being 12
58 bottom partition of 54 being 12
60 semicircular housing for 50
62 front partition of 60 being 12
64 top partition of 60 being 12

The piece of illuminated furniture 10 comprises a diffuser 12 built therein that spreads light evenly. A light source 14 is within the diffuser 12 to produce illumination therefrom.

The diffuser 12 is fabricated out of translucent material 16. The translucent material 16 can be made of glass or plastic. The light source 14 is a lamp 18.

The lamp 18 includes a socket shell 20. A bracket 22 is for mounting the socket shell 20 within the diffuser 12. A light bulb 24 is in the socket shell 20, while a power cord 26 extends from the socket shell 20. An electric plug 28 is on a distal free end of the power cord 26 to engage with a wall socket 30, to carry electricity to the light bulb 24.

The piece of illuminated furniture 10 can be a chair 32 with the diffuser 12 and light source 14 located under a seat 34 of the chair 32. The piece of illuminated furniture 10 can also be a table 26 having a plurality of legs 38 and top 40. The diffuser 12 and the light source 14 are located under said top 40 of the table 36 between the legs 38, to function as a frieze thereabout.

The diffuser 12 in the table 36 includes a cylindrical band 42. A first ring 44 is secured about the legs 38 of the table 36 directly above the cylindrical band 42. A second ring 46 is secured about the legs 38 of the table 36 directly below the cylindrical band 42. The first ring 44 and the second ring 46 will hold the cylindrical band 42 in place. The top 40 of the table 36 can be part of the diffuser 12 by being fabricated out of the translucent material 16. The table 36 further includes an adjustable support assembly 48 between the legs 38, so as to stabilize the table 36 with the diffuser 12 and the light source 14 therein.

Figure 8:
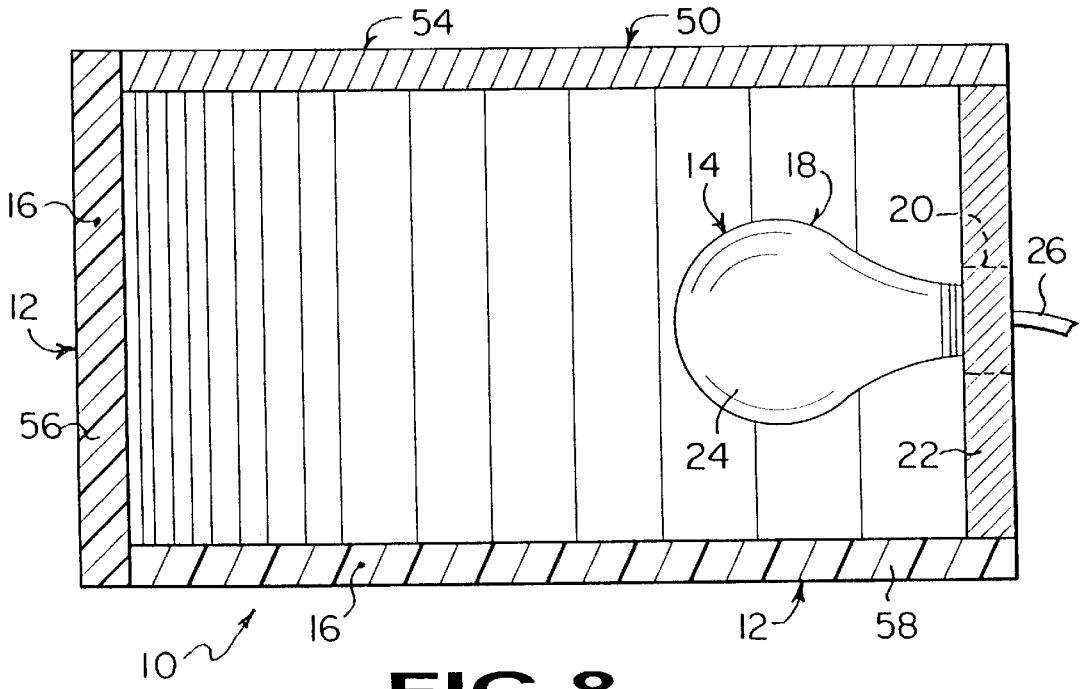
FIG. 8 is a cross sectional view taken along line 8—8 in FIG. 4.
Figure 9:
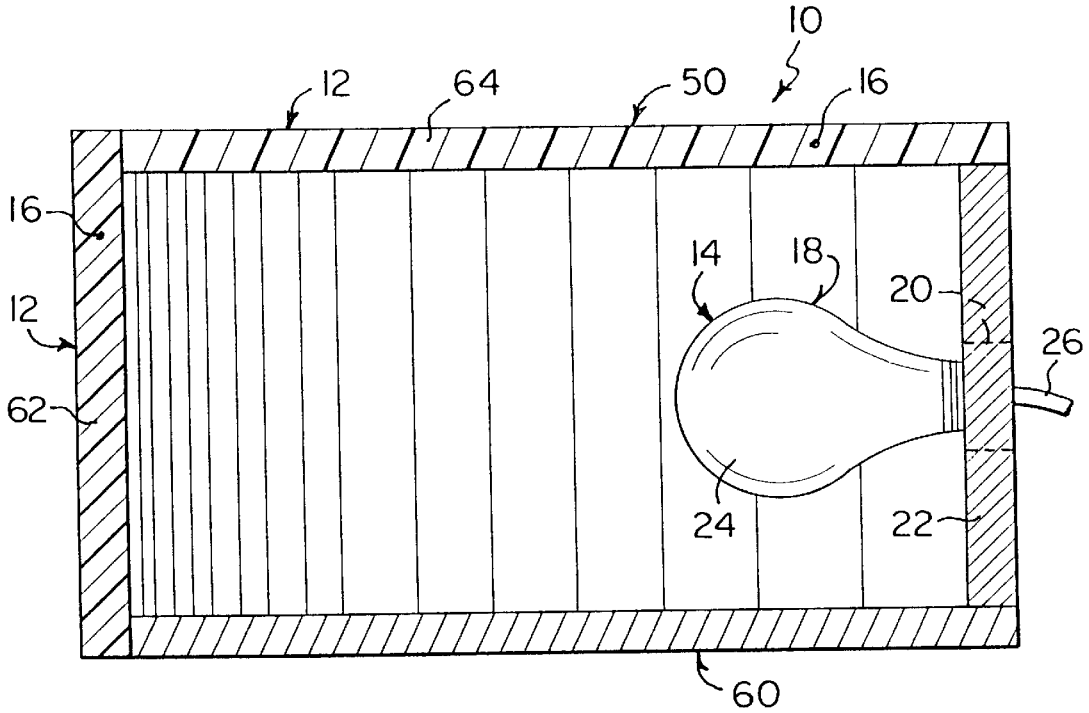
FIG. 9 is a cross sectional view taken along line 9—9 in FIG. 5.

The piece of illuminated furniture 10 can be a shelf 50 mountable to a wall 52, with the diffuser 12 and the light source 14 located within the shelf 50. The shelf 50, as best seen in FIG. 8, is a semicircular housing 54 having a front partition 56 and a bottom partition 58 being the diffuser 12. The shelf 50, as best seen in FIG. 8, is a semicircular housing 60 having a front partition 62 and top partition 64 being the diffuser 12.

Operation of the Invention

To use the piece of illuminated furniture 10, being the chair 32 the following steps should be taken:

1. Place the legs of the chair 32 upon the floor adjacent the wall socket 30.

2. Screw the light bulb 24 into the socket shell 20 of the lamp 18.

3. Insert the electric plug 28 on the distal free end of the power cord 26 into the wall socket 30.

4. Make sure that the light bulb 24 is good by checking to see how it illuminates from within the diffuser 12.

To use the piece of illuminated furniture 10, being the table 36, the following steps should be taken:

1. Place the legs 38 of the table 36 upon the floor adjacent the wall socket 30.

2. Screw the light bulb 24 into the socket shell 20 of the lamp 18.

3. Insert the electric plug 28 on the distal free end of the power cord 26 into the wall socket 30.

4. Make sure that the light bulb 24 is good by checking to see how it illuminates from within the diffuser 12.

The use the piece of illuminated furniture 10, being the shelf 50, following steps should be taken:

1. Screw the light bulb 24 into the socket shell 20 of the lamp 18.

2. Connect the power cord 26 to the electric circuit within the wall 52.

3. Mount the flat portion of the semicircular housing 54/60 to the wall 52.

4. Make sure that the light bulb 24 is good by checking to see how it illuminates from within the diffuser 12.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A piece of illuminated furniture comprising:

a) a table having a plurality of legs and a top;

b) a diffuser built in said table that spreads light evenly including:

i) a cylindrical band;

ii) a first ring secured about said legs of said table directly above said cylindrical band; and iii) a second ring secured about said legs of said table directly below said cylindrical band, so that said first ring and said second ring will hold said cylindrical band in place; and c) a light source within said diffuser to produce illumination therefrom, said diffuser and said light source located under said top of said table between said legs, to function as a frieze thereabout.

2. A piece of illuminated furniture as recited in claim 1, wherein said diffuser is fabricated out of translucent material.

3. A piece of illuminated furniture as recited in claim 2, wherein said translucent material is made of glass.

4. A piece of illuminated furniture as recited 2, wherein said translucent material is made of plastic.

5. A piece of illuminated furniture as recited 1, wherein said light source is a lamp.

6. A piece of illuminated furniture as recited 5, wherein said lamp includes:

a) a socket shell;

b) a bracket for mounting said socket shell within said diffuser;

c) a light bulb in said socket shell;

d) a power cord extending from said socket shell; and e) an electric plug on a distal free end of said power cord to engage with a wall socket, to carry electricity to said light bulb.

7. A piece of illuminated furniture as recited 1, wherein said top of said table is part of said diffuser by being fabricated out of translucent material.

8. A piece of illuminated furniture as recited in claim 1, wherein said table further includes an support assembly between said legs, so as to stabilize said table with said diffuser and said light source therein.

* * * * *